United States Patent [19]

Francis

[11] Patent Number: 4,739,970

[45] Date of Patent: Apr. 26, 1988

[54] ROTARY ANTI-SCALING DEVICE

[75] Inventor: Joseph R. Francis, Ouston, England

[73] Assignee: Hercules Security Fabrications Limited, Gateshead, United Kingdom

[21] Appl. No.: 35,354

[22] Filed: Apr. 7, 1987

[30] Foreign Application Priority Data

Apr. 10, 1986 [GB] United Kingdom ..... 8608718

[51] Int. Cl.[4] ..... E04H 17/00

[52] U.S. Cl. ..... 256/12; 256/1; 256/16

[58] Field of Search ..... 256/12, 16, 11, 1

[56] References Cited

U.S. PATENT DOCUMENTS

| | | | |
|---|---|---|---|
| 511,700 | 12/1893 | Jacobs | 256/12 |
| 1,543,790 | 6/1925 | Pehrson | 256/16 |
| 4,270,736 | 6/1981 | Burch | 256/12 |
| 4,348,012 | 9/1982 | McLoughlin | 256/16 X |

*Primary Examiner*—Andrew V. Kundrat

*Attorney, Agent, or Firm*—Hopgood, Calimafde, Kalil, Blaustein & Judlowe

[57] ABSTRACT

A rotary anti-scaling device comprises a pair of substantially identical halves connected together at a relative displacement of 180° about a central transverse axis through the halves to form a unitary spike. Each half includes a central body portion with a central, transversely-extending bore therethrough permitting rotation of the unitary spike on an associated mounting bar, one or more projections extending from opposed ends of each body portion and at least one of the body portions having means formed thereon for co-operating with an adjacent spike to locate said spike in a position displaced angularly about its transverse axis relative thereto.

10 Claims, 3 Drawing Sheets

ROTARY ANTI-SCALING DEVICE

BACKGROUND OF THE INVENTION

This invention relates to rotary anti-scaling devices such as are positioned on the top of fences, walls, gates and the like to prevent potential intruders scaling such structures.

Established rotary anti-scaling devices are usually one of two known arrangements. The first of these is a turnpike construction which includes four bars protruding from, and spaced at 90° intervals around, a central mounting bar. However it has proved relatively easy to tie a rope around such bars to enable scaling of the associated structures, while the bars of adjacent turnpikes can readily be aligned with each other to provide a uniform construction which is prone to scaling.

The other arrangement currently in use comprises sections or vanes of expanded metal or welded mesh, typically of about 20 inch widths, projecting from a central rotary bar, such an arrangement being of relatively fragile construction and prone to being pulled down.

A further disadvantage of both the above-mentioned devices is that they are of relatively complex and unattractive construction and are therefore expensive to produce and detract significantly from the visual appearance of the associated structure.

SUMMARY OF THE INVENTION

It is an object of the invention to provide a rotary anti-scaling device of a relatively cheap and decorative construction which is significantly less prone to scaling than the known devices.

According to the present invention there is provided a rotary anti-scaling device comprising a pair of substantially identical halves adapted to be connected together at a relative displacement of 180° about a central transverse axis therethrough to form a unitary spike, the halves including central body portions centrally through which are formed aligned bores extending along said transverse axes whereby the unitary spike can be rotatably mounted on an associated bar, each body portion having one or more projections extending from opposed ends thereof, at least one of said body portions having formed thereon means for co-operating with an adjacent spike to locate said adjacent spike in a position displaced angularly about its transverse axis relative thereto, conveniently through 90°.

Preferably the body portions of each half have substantially flat inner surfaces adapted to abut one another and each provided with co-operating male and female connecting pieces to locate the halves of the unitary spike relative to one another. The connecting pieces conveniently comprise a projection and a corresponding recess on the inner surface of each body portion to either side of the associated bore.

The means formed on a body portion for co-operation with the adjacent spike may comprise a pair of diametrically opposed lugs formed one to each side of the bore through the body portion and extending axially of said bore to define between them diametrically opposed slots to receive therein the lugs of a body portion of the adjacent spike. Said means may be formed on one only or on both of the body portions.

Preferably the device is moulded from a high impact thermoplastic material, although metal may be used.

Conveniently each half of a device includes two pairs of projections integrally formed with the body portion, one pair extending from each end of the body portion, a preferred device further including a high tensile metal nail moulded into each half to project from one end thereof between the associated pair of projections, the two nails of a device projecting from opposite ends thereof and the free end of each nail being substantially co-planar with the ends of the associated projections.

In use, a plurality of such devices as detailed about are rotatably mounted on a bar fixed to the top of the associated fence, wall, gate or the like with adjacent devices angularly displaced relative to one another, a rotatable sleeve encasing the bar being interposed between the bar and the devices.

DESCRIPTION OF THE PREFERRED EMBODIMENTS

Figure 3:
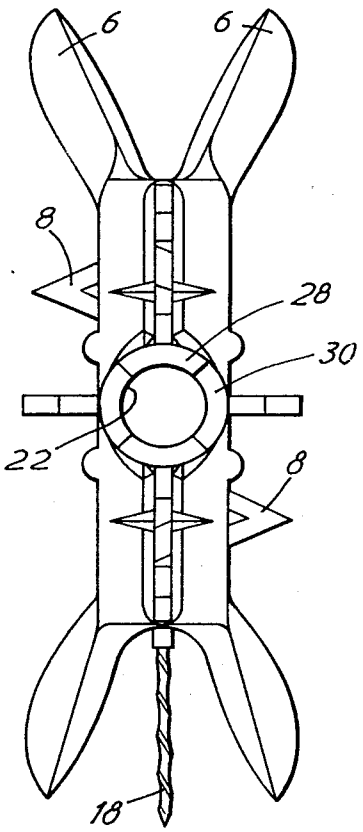
FIG. 3 is a view in the direction of arrow 'B' of FIG. 1.
Figure 2:
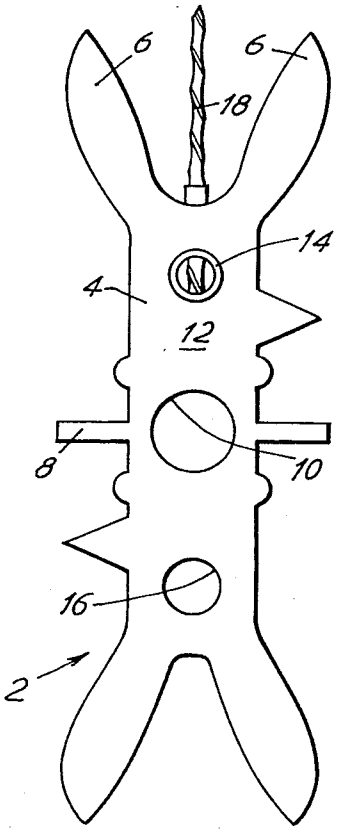
FIG. 2 is a view in the direction of arrow 'A' of FIG. 1.
Figure 1:
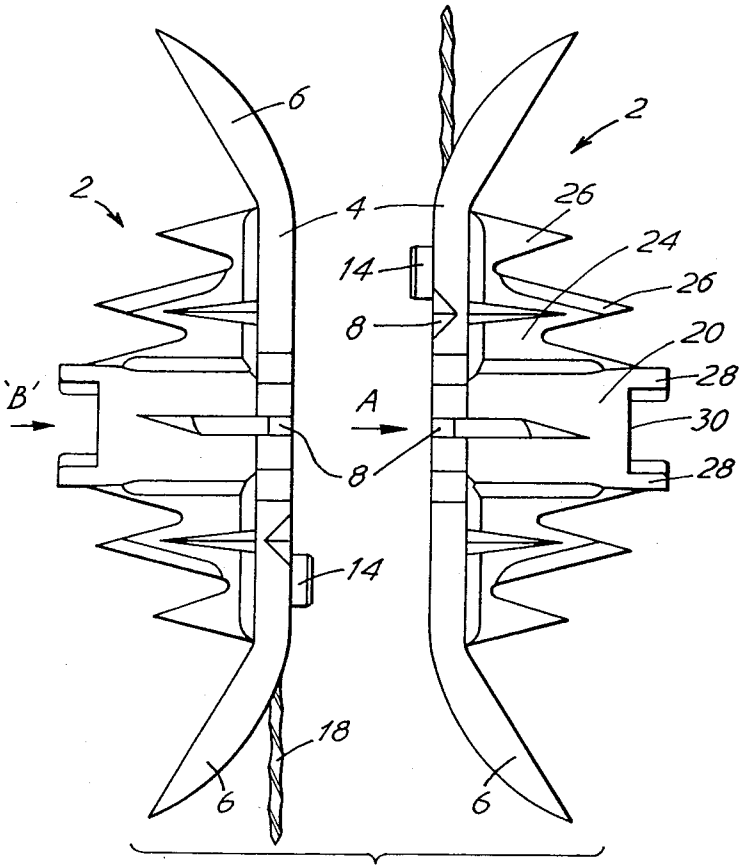
FIG. 1 is a front view of a first device according to the invention with the halves thereof separated.

Referring to FIGS. 1 to 3 of the drawings, the illustrated rotary anti-scaling device comprises two identical halves each of which is indicated generally at 2.

More particularly, each half 2 is moulded from a high impact thermo-plastic material such as NYLON 6 with additives and includes a central body portion 4 of generally elongate rectangular shape from each of the opposed ends of which extend a pair of generally arcuate projections in the form of needles or spikes 6 having sharp edges and points thereto. Pointed spikes 8 extend laterally of the body portion 4 as shown, while a bore 10 is formed centrally of said body portion.

Each body portion 4 includes a substantially flat inner surface 12 thereto, on which are symmetrically formed, to one side of the bore 10, a hollow, circular projection 14 and, to the other side of the bore 10, a correspondingly-shaped recess 16 for reasons which will become apparent.

A hardened steel pin 18 is moulded into one end of the body portion 4 to extend between the adjacent pair of needles or spikes 6.

A tubular member 20, the bore 22 of which forms a continuation of the bore 10, projects outwardly of the body portion 4, webs 24 being provided between the outer surface of the body portion 4 and said tubular member 20 thus increasing the strength of the device, serrations or teeth 26 being formed on said webs 24 to extend substantially parallel with the central axis of the bores 10,22.

The outer end of the tubular member 20 of each half 2 is provided with diametrically opposed lugs 28 thereon extending axially thereof one to either side of the bore 22 and defining between them diametrically opposed slots 30.

It will be appreciated that the two identical halves as described, when located as shown in FIG. 1 at a realtive displacement of 180° to one another about the central transverse axes thereof, and with the surfaces 10 facing one another, can be interconnected by location of the projections 14 into the corresponding recesses 16 to form a symmetrical unitary spike having a continuous central bore therethrough.

Figure 5:
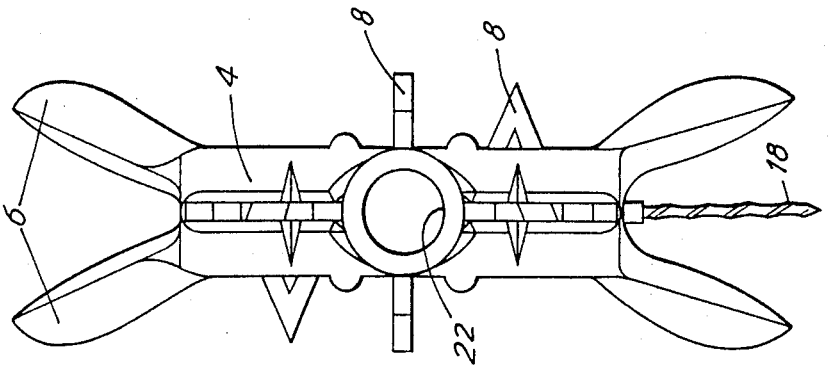
FIG. 5 is a view in the direction of arrow 'C' of FIG. 4.
Figure 4:
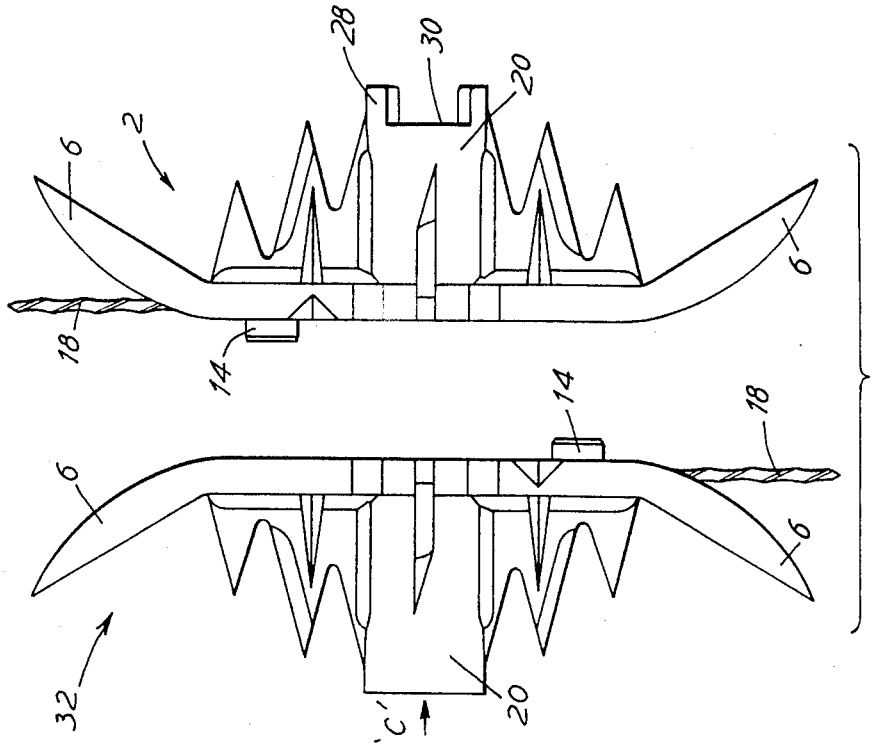
FIG. 4 is a front view of a second device according to the invention with the halves thereof separated.

FIGS. 4 and 5 illustrate a slightly modified device according to the invention again comprising two halves one of which is identical with those shown in FIGS. 1 to 3 and is referenced generally at 2. The other half, referenced 32, is the same as the halves 2 except that the end of the tubular member 20 does not have the lugs 28 and slots 30 formed therein and has a continuous annular end thereto.

Spikes as described above are to be mounted on, to be rotatable relative to, an associated fixed bar located above a structure to be protected, such as a wall, a gate, a fence, a drainpipe or the like.

Figure 6:
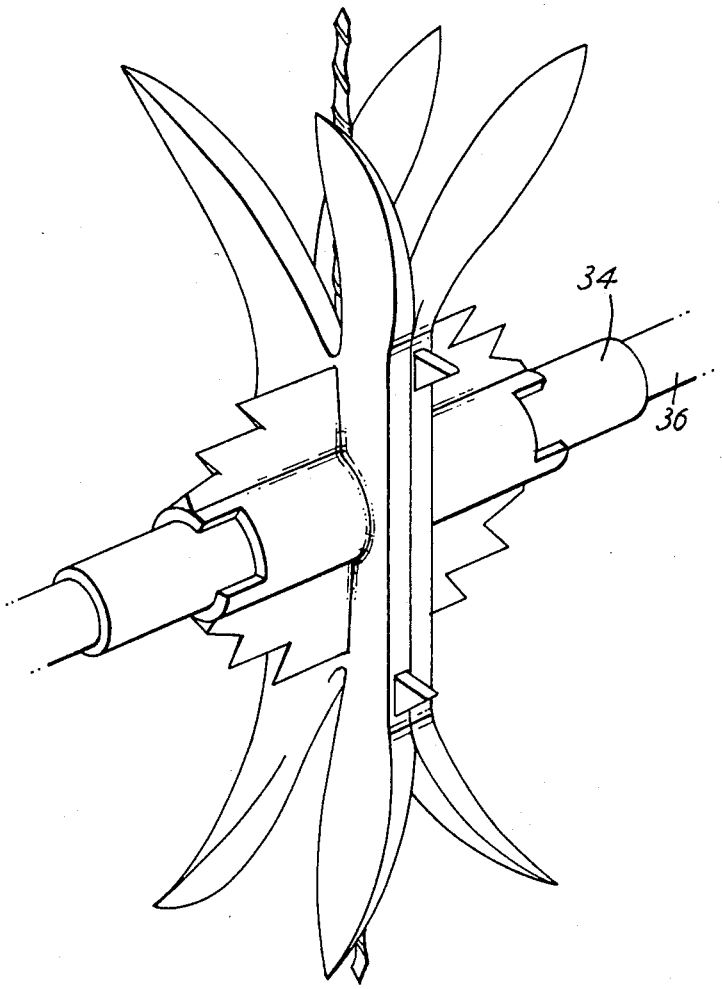
FIG. 6 is a perspective view of a third device according to the invention mounted on an associated rotatable sleeve.

More particularly, a freely rotatable sleeve such as that shown at 34 in FIG. 6 is mounted on, to encase, the fixed bar 36, and a plurality of spikes are mounted in units of, for example, two or three on the sleeve 34 to be freely rotatable as units on said sleeve.

A unit of three spikes comprises a central spike as illustrated in FIGS. 1 to 3 and a pair of spikes as illustrated in FIGS. 4 and 5, one to each side of the central spike, with the body halves 2 of the outer spikes having the lugs 28 thereof received within the slots 30 of the adjacent halves of the central spike whereby adjacent spikes of a unit are displaced through 90° relative to one another and rotate as a unit with one another.

Similarly a unit of two spikes comprises two spikes as illustrated in FIGS. 4 and 5 interconnected with one another as above and displaced through 90° relative to one another.

In both cases it will be appreciated that the outermost halves of the outermost spikes comprise halves 32 with flat outer ends to the tubular members 20 whereby there is no interconnection or co-operation between adjacent units and said units rotate independently of one another.

The provision of a plurality of units on a length of bar and containing different numbers of spikes is of a distinct advantage in that, if a blanket or the like is thrown over the bar by a potential vandal, the units will rotate at different speeds and therefore make it even more difficult to scale the associated structure.

The particular construction of the individual spikes makes it virtually impossible for the intruder a grab hold of the device because of the many and various sharp edges and points thereon or to lash a rope thereto without the severe risk of the rope being cut through.

Should the vandal attempt to cut off the needles or spikes 6, the nails 18 still present severe obstacles as they are virtually indestructable.

The provision of a freely rotatable sleeve 34 between the spikes and the fixed bar eliminates the possibility of a potential intruder being able to saw through the fixed bar with a view to removing the spikes therefrom—any attempt to saw through the sleeve 34 merely results in rotation of the sleeve itself.

It is preferred that the needles 6 and the nail 18 at each end of a device all terminate in the same plane so that, in the event that an intruder falls onto a unit, he is not impaled thereby.

Clearly two or more tiers of devices can be provided on any given structure, while alternate devices of a unit may be of different sizes.

The material of the devices, conveniently NYLON 6 with additives, is rustproof, lightweight, flame retardant and is treated for ultraviolet light so as to avoid deterioration in strength of the material even on prolonged exposure to sunlight.

It is anticipated that the described device, which is cheap and easy to manufacture, will have a life of 20 years or more, there being no corrosive parts thereto, while the device has a major advantage over other known arrangements in its extremely decorative appearance. More particularly, the halves can be moulded in a variety of colours, and individual spikes may comprise halves of different colours or alternate spikes of a unit or along a mounting bar can be of different colours.

It will be appreciated that this facility has particular application in football grounds where the spikes may be in the colours of the home team.

FIG. 6, as well as showing the tubular sleeve 34, shows a slightly modified anti-scaling device according to the invention, the particular configuration of the needles and supplementary spikes thereon being slightly different from those of the devices of FIGS. 1 to 5 but the basic concept thereof being the same.

The fixed bar 36 on which the spikes and the rotatable sleeve 34 are mounted may extend between opposed brackets mounted on the top of the structure being protected, said brackets each being drilled to contain a pair of hardened nails such as those referenced 18 freely encapsulated therein. The presence of the freely rotatable hardened nails in this manner prevents a potential intruder from hacksawing through the brackets with a view to removing the complete assembly from the structure.

What I claim and desire to secure by Letters Patent is:

1. A rotary anti-scaling device comprising a pair of substantially identical halves each having a central transverse axis therethrough and adapted to be connected together at a relative displacement of 180° about said axis to form one unitary spike, the halves including central body portions defining centrally therein aligned bores extending along the transverse axes thereof whereby the unitary spike can be rotatably mounted on an associated bar, each body portion having diametrically opposed ends thereto, one or more projections extending from each of said opposed ends, and means formed on at least one of said body portions for cooperating with an axially aligned adjacent spike to locate said spikes in a position wherein the opposed ends of said one spike are in angularly displaced relation to the opposed ends of the adjacent spike.

2. A rotary anti-scaling device comprising a pair of substantially identical halves each having a central transverse axis therethrough and adapted to be connected together at a relative displacement of 180° about said axes to form one unitary spike, the halves including central body portions defining centrally therein aligned bores extending along the transverse axes thereof whereby the unitary spike can be rotatably mounted on an associated bar, each body portion having opposed ends thereto, one or more projections extending from each of said opposed ends, and means formed on at least one of said body portions for cooperating with an axially aligned adjacent spike to locate said spikes in a position wherein the opposed ends of said one spike are in angularly displaced relation to the opposed ends of the adjacent spike, the body portions of each half each including substantially flat inner surfaces adapted to abut one another, cooperating male and female connecting pieces being provided on each half to locate said halves of the unitary spike relative to one another.

3. A rotary anti-scaling device as claimed in claim 2 in which the connecting pieces comprise a projection on, and a corresponding recess formed in, the inner surface of each body portion on either side of the associated bore.

4. A rotary anti-scaling device as claimed in claim 2 in which the means formed on a body portion for co-operation with the adjacent spike comprise a pair of diametrically opposed lugs formed one to each side of the bore through the body portion and extending axially of said bore to define between them diametrically opposed slots to receive therein the lugs of a body portion of the adjacent spike.

5. A rotary anti-scaling device as claimed in claim 4 in which said means for co-operating with an associated adjacent spike are formed on one only of the body portions thereof.

6. A rotary anti-scaling device as claimed in claim 4 in which means for co-operating with an associated adjacent spike are formed on both body portions thereof.

7. A rotary anti-scaling device as claimed in claim 1 and including two pairs of projections integrally formed with the body portion of each half of the device, one pair of projections extending from each end of each body portion.

8. A rotary anti-scaling device comprising a pair of substantially identical halves each having a central transverse axis therethrough and adapted to be connected together at a relative displacement of 180° about said axis to form one unitary spike, the halves including central body portions defining centrally therein aligned bores extending along the transverse axes thereof whereby the unitary spike can be rotatably mounted on an associated bar, each body portion having opposed ends thereto, two pairs of projections integrally formed with the body portion of each half of the device, one pair of projections extending from each end of each body portion, and means formed on at least one of said body portions for cooperating with an axially aligned adjacent spike to locate said spikes in a position wherein the opposed ends of said one spike are in angularly displaced relation to the opposed ends of the adjacent spike, a high tensile metal nail moulded into each half to project from one end thereof between the associated pair of projections, each projection and each nail having a free end thereto, the two nails of the device projecting from opposite ends thereof with the free end of each nail being substantially co-planar with the free ends of the associated projections.

9. A rotary anti-scaling device as claimed in claim 8 in which the two halves thereof are each moulded from a high impact thermoplastic material.

10. A rotary anti-scaling device as claimed in claim 1 and rotatably mounted on a tubular sleeve, said sleeve being adapted to be rotatably mounted on, to encase, the associated bar.

* * * * *